US009326647B2

(12) United States Patent
Larson et al.

(10) Patent No.: US 9,326,647 B2
(45) Date of Patent: May 3, 2016

(54) APPARATUS FOR DISPENSING ABSORBENT SHEET MATERIAL FROM A ROLL

(75) Inventors: Björn Larson, Billdal (SE); Craig Billman, Phoenixville, PA (US); John S. Formon, Oxford, PA (US); Erik Hjort, Borlänge (SE); Per Möller, Borlänge (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 0 days.

(21) Appl. No.: 14/400,638

(22) PCT Filed: May 15, 2012

(86) PCT No.: PCT/SE2012/050521

§ 371 (c)(1),
(2), (4) Date: Nov. 12, 2014

(87) PCT Pub. No.: WO2013/172752

PCT Pub. Date: Nov. 21, 2013

(65) Prior Publication Data

US 2015/0097068 A1 Apr. 9, 2015

(51) Int. Cl.
*B65H 26/00* (2006.01)
*A47K 10/22* (2006.01)
(Continued)

(52) U.S. Cl.
CPC ..... *A47K 10/22* (2013.01); *A47K 10/34* (2013.01); *A47K 10/36* (2013.01); *A47K 2010/3675* (2013.01); *A47K 2010/3681* (2013.01)

(58) Field of Classification Search
CPC ..... A47K 10/22; A47K 10/34; A47K 10/36
USPC ..... 242/564, 564.1, 564.5, 912
See application file for complete search history.

(56) References Cited

U.S. PATENT DOCUMENTS 3,260,402 A * 7/1966 Lareau ..... A47K 10/20 221/186
3,896,691 A * 7/1975 Granger ..... A47K 10/36 225/17

(Continued)

FOREIGN PATENT DOCUMENTS

EP 0 933 054 A2 8/1999
EP 1 206 919 A2 5/2002

(Continued)

OTHER PUBLICATIONS

International Search Report (PCT/ISA/210) mailed on Jan. 11, 2013, by the Swedish Patent Office as the International Searching Authority for International Application No. PCT/SE2012/050521.

(Continued)

*Primary Examiner* — William A Rivera
(74) *Attorney, Agent, or Firm* — Buchanan & Ingersoll & Rooney PC

(57) ABSTRACT

An object of the present disclosure is to provide an apparatus for dispensing absorbent sheet material from a roll. The apparatus includes a roll holder for rotatably supporting said roll, and a roll fill level indicator arrangement. The roll fill level indicator arrangement includes a pivoting arm and a moveable first indicator device. The pivoting arm includes roll engagement device for engagement with an outer peripheral surface of said roll. A position of said first indicator device is continuously responsive to an angular position of said pivoting arm, such that said roll fill level indicator arrangement is able to provide a gradual roll fill level indication.

20 Claims, 5 Drawing Sheets

(51) Int. Cl.
*A47K 10/36* (2006.01)
*A47K 10/34* (2006.01)

(56) References Cited

U.S. PATENT DOCUMENTS

| | | | | |
|---|---|---|---|---|
| 4,487,375 | A | 12/1984 | Rasmussen et al. | |
| 5,244,161 | A | 9/1993 | Wirtz-Odenthal | |
| 6,006,642 | A | 12/1999 | Granger | |
| 6,027,002 | A | 2/2000 | Granger | |
| 6,092,451 | A | 7/2000 | Granger | |
| 6,360,181 | B1 | 3/2002 | Gemmell et al. | |
| 6,517,025 | B1 * | 2/2003 | Budz | A47K 10/3818 242/563 |
| 6,908,059 | B2 * | 6/2005 | Budz | A47K 10/3818 242/563 |
| 7,338,007 | B2 | 3/2008 | Valot | |
| 7,434,760 | B2 | 10/2008 | Budz et al. | |
| 7,546,973 | B2 | 6/2009 | Budz et al. | |
| 7,648,098 | B2 | 1/2010 | Goeking et al. | |
| 9,113,760 | B2 * | 8/2015 | Knapp | A47K 10/3818 |
| 2002/0113162 | A1 * | 8/2002 | Fournier | B41J 17/36 242/563.2 |
| 2007/0194166 | A1 | 8/2007 | Reinsel et al. | |

FOREIGN PATENT DOCUMENTS

| | | | |
|---|---|---|---|
| SE | 364 178 | B | 2/1974 |
| WO | WO 2007/068884 | A2 | 6/2007 |
| WO | WO 2009/135235 | A2 | 11/2009 |

OTHER PUBLICATIONS

International Preliminary Report on Patentability (PCT/IPEA/409) mailed on Mar. 12, 2014, by the Swedish Patent Office as the International Searching Authority for International Application No. PCT/SE2012/050521.

* cited by examiner

FIG.4
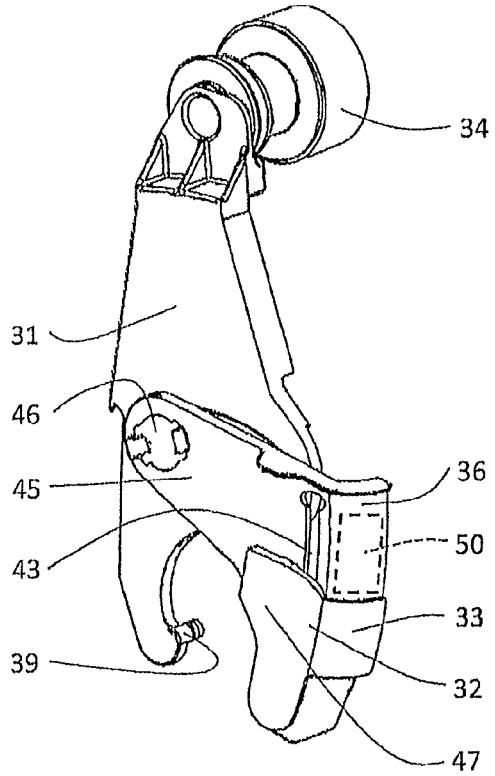
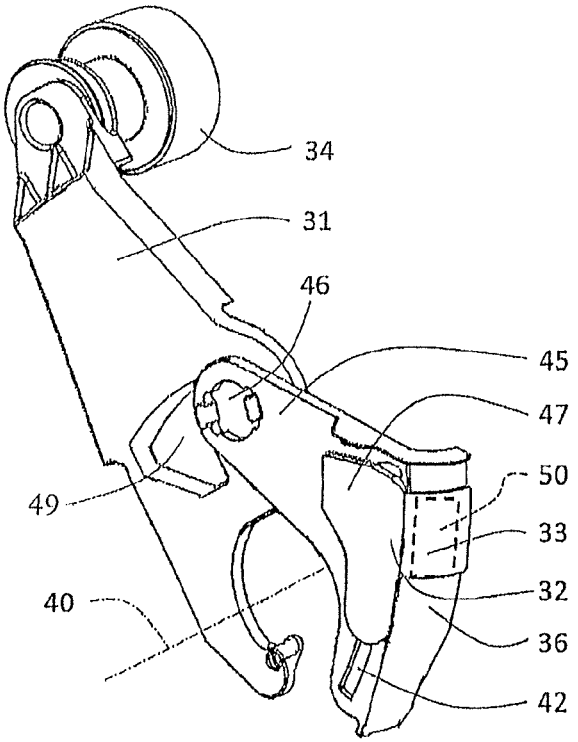
FIG.5

APPARATUS FOR DISPENSING ABSORBENT SHEET MATERIAL FROM A ROLL

TECHNICAL FIELD

The present disclosure relates to an apparatus for dispensing absorbent sheet material from a roll, wherein the apparatus comprising a roll holder for rotatably supporting said roll, and a roll fill level indicator arrangement. The present disclosure relates to dispensing apparatus with automatic, semi-automatic or manual dispensing, and sheet material includes paper hand wipes, general-purpose paper wipes, toilet paper and similar wipes. The roll is preferably a hard wound roll towel (HWRT), and the apparatus is preferably configured to be mounted on a wall, readily accessible to a user.

BACKGROUND ART

Apparatus for dispensing absorbent sheet material from a roll, also referred to as absorbent sheet material dispensers, are well-known in the prior art. The absorbent sheet roll of the dispenser is regularly replaced upon depletion, and various solutions for easily allowing service personnel to check the current fill level of the roll, i.e. the amount of absorbent sheet material that is still available for consumption of the roll, exists.

One solution for the service personnel to check roll fill level is to simply open the outer cover of the dispenser to determine current fill level. This procedure however is time consuming and results in high wear of the cover opening and locking mechanism. Another solution is to provide the outer cover of the dispenser with a window that allows the service personnel to see the roll from the outside of the dispenser, and thus to determine the roll fill level without opening the outer cover. This procedure allows more swift check of the roll fill level but may be unattractive from a dispenser design perspective. Yet another solution, which is known from EP0933054, involves providing a roll diameter sensor and an indicator for providing an indication to a service personal when the roll has reached a predetermined diameter. A disadvantage with this solution is the complexity of the sensor and indication mechanism, the additional work required by the service personal to handle the sensor and indication mechanism during replacement of the roll, and the that fact that the roll may be replaced with a relatively large amount of absorbent sheet material still available on the roll merely because the indicator has been actuated.

There is thus a need for an improved apparatus for dispensing absorbent sheet material from a roll that removes the above mentioned disadvantages.

SUMMARY

An object of the present disclosure is to provide an inventive apparatus for dispensing absorbent sheet material from a roll, where the previously mentioned problems are partly avoided. This object is achieved by the features of the characterising portion of claim 1.

In the subsequent text, the term "housing" is defined as a collective term for all components forming the outer shell of a dispenser or of an enclosed portion thereof. Hence, an outer housing may be considered to comprise component parts such as a chassis or rear wall, which may comprise means for mounting the dispenser on a wall and be used for attaching internal components, and one or more outer walls, such as a front wall, side walls and a pivoted or removable cover allowing re-filling of the dispenser. One or more outer walls may be a part of the chassis or be mounted separately as one or more units. Alternatively, the cover may make up a major part of the front wall or the front wall and side walls. The front wall may be defined as including the front and upper portions of the dispenser housing. In addition, an outer housing may comprise an inner housing in the form of a casing or cassette enclosing at least part of a feeding mechanism for the material to be dispensed, which casing or cassette can be mounted to the chassis separate from the outer walls. An inner housing may comprise component parts, such as a front wall, side walls, etc.

The apparatus for dispensing absorbent sheet material from a roll according to the present disclosure comprises a roll holder for rotatably supporting said roll, and a roll fill level indicator arrangement. The roll fill level indicator arrangement comprising a pivoting arm, and a moveable first indicator device. The pivoting arm comprises a roll engagement means for engagement with an outer peripheral surface of the roll, and a position of the first indicator device is continuously responsive to an angular position of the pivoting arm, such that the roll fill level indicator arrangement is able to provide a gradual roll fill level indication.

The dispenser according to the present disclosure allows swift and easy determination of the current roll fill level from the outside of the dispenser, and the service personnel consequently does not open the dispenser for checking roll fill level. The gradual roll fill level indication provided by the present disclosure results in a more accurate fill level determination than provided by the prior art solution described above, where only a single discrete fill level indication is provided, i.e. an indication when the roll size has been reduced to a predetermined diameter. Thereby, the service personal can more optimally select the timing for replacing the roll, depending on the specific circumstances for each dispenser.

Further advantages are achieved by implementing one or several of the features of the dependent claims.

For example, the roll fill level indicator arrangement may further comprise a second indicator device, which is stationary with respect to said apparatus, wherein said gradual roll fill level indication is realised by an internal relative position of said first and second indicator devices. This configuration has the advantage of allowing a swift and easy reading of the current roll fill level.

Further, the first indicator device may be a separate part that is movable connected to said pivoting arm. This configuration, in which the motion of the first indicator part is not limited to the strict pivoting motion of the pivoting arm, has the advantage of allowing more freedom of motion of the first indicator device, such as a linear sliding motion, or the like.

Still further, the first indicator device may be configured to be slidingly arranged in a stationary part of said apparatus, which stationary part partly constrains the sliding motion of said first indicator device. This configuration has the advantage of making the first indicator device more readable by a user or service personnel from outside the dispenser. Moreover, the partly constrained sliding motion results in a well-defined sliding motion, high reliability and robustness of the roll fill level indicator arrangement, as well as high aesthetical appearance.

Further, the first indicator device may be pivotally connected to said pivoting arm, such that pivotal motion of said pivoting arm results in sliding motion of said first indicator device. This configuration has the advantage of providing a reliable and robust design of the roll fill level indicator arrangement.

Further, the first indicator device may be configured to move along a curved or straight sliding path. This configuration has the advantage of providing easy and accurate reading of the fill level indicator arrangement.

Further, the first indicator device may be configured to move along linear or slightly curved path that extends in a plane perpendicular to an axial direction of said roll holder. This configuration has the advantage of a less complex motion transfer mechanism between the roll engagement means of the pivoting arm and the first indicator mechanism, because the roll engagement means will also move in said plane perpendicular to an axial direction of said roll holder.

Further, the first indicator device may be an integral part of said pivoting arm. This configuration has the advantage of providing a robust and reliable fill level indicator arrangement with a minimal of separate parts, and which therefore also involves a more cost-effective manufacturing.

Further, the second indicator device may be formed by a window in a stationary wall of said apparatus, wherein an indicator surface of said first indicator device is configured to overlap with said window at least during a certain fill level of said roll, such that said indicator surface is visible through said window. This configuration has the advantage of providing a cost-effective and aesthetically attractive solution for an accurate and easily readable fill level indicator arrangement. The ratio of visibility of the first indicator device to the total area of the window inherently offers an easy understandable indication of the current roll fill level.

Further, the pivoting arm may be pivotable between a first position and a second position about a pivoting axis, and said indicator surface of said first indicator device may be configured to completely overlap with said window when said pivoting arm is in said first position, and said indicator surface of said first indicator device may be configured to be completely offset said window when said pivoting arm is in said second position. This configuration has the advantage of maximising the range of said ratio of visibility of the first indicator device to the total area of the window, such that more accurate reading of the current roll fill level may be accomplished.

Moreover, the roll fill level indicator arrangement may further comprise a background indicator device arranged rear of said first indicator device, and an indicator surface of said background indicator device may be configured to be visible in said window when said indicator surface of said first indicator device does not completely overlap with said window. This configuration has the advantage of always providing an indicator surface readily viewable in the window, irrespective of the current position of the first indicator device, such that the current fill level status may always be swiftly and accurately determined merely be viewing said indicator surfaces. Preferably, the indicator surfaces of both said background indicator device and said first indicator device are provided with individual markings and/or colourings to even further allowing a clear distinction between said surfaces.

Further, the background indicator device may form said stationary part. This configuration has the advantage of providing cost-effective manufacturing of the dispenser, as well as improved serviceability, because the indicator arrangement may be designed more compact and with less mechanical interaction with other parts of the dispenser.

Further, the background indicator device may be a separate part of said roll fill level indicator arrangement. This configuration, similar to above, has the advantage of providing cost-effective manufacturing of the dispenser, as well as improved serviceability, because the indicator arrangement may be designed more compact and with less mechanical interaction with other parts of the dispenser.

Further, the a ratio of the amount of visible indicator surface of said first indicator device to the amount of visible indicator surface of said background indicator device may be configured to correspond to current roll fill level. This configuration has the advantage of providing an inherent and easily understandable visualisation of the current roll fill level.

Further, the indicator surface of said first indicator device may extend longer than said window in a motion direction of said first indicator device, and said indicator surface of said first indicator device may have roll fill level marking that is configured to correspond to a predetermined roll fill level range, such that the marking currently visible in said window indicates the current roll fill level. This configuration has the advantage of always providing an indicator surface visible in the complete area of the window, thereby increasing readability of the indicator arrangement. There is also no need for a background indicator device, such that a less complex design with fewer parts is provided.

Further, the stationary wall may be any of a front wall, a side wall, a top wall, or an inner wall that is visible to a user from an outside of said apparatus. This configuration has the advantage of improving readability of the fill level indicator arrangement. A front wall is preferred because then readability of the indicator arrangement is independent of the mounting of the dispenser next to other objects.

Moreover, one of said first and second indicator devices may comprise a roll fill level marking that is configured to correspond to a predetermined roll fill level range, and the other of said first and second indicator devices may comprise an indicator member that is configured to indicate the current roll fill level by interaction with said roll fill level marking. This configuration has the advantage of not requiring a window as second indicator device, and instead allowing other designs for indicating the roll fill level.

Further, the roll engagement means may be formed by a rotatable wheel that is arranged at an end region of said pivoting arm, which wheel is configured to apply a rotational braking force to said roll for preventing absorbent sheet material from being uncontrollably unwound from said roll. This configuration has the advantage of engaging the outer surface of the roll without risk for damages thereof, as well as allowing a certain level of frictional braking torque to be applied to the roll after completed removal by a user. The braking torque is preferably accomplished by controlling rotation of the wheel by means of a band, or the like, such that the forced rotation of the wheel corresponds to the withdrawal of sheet material. The roll is thus largely prevented from continued rotation due to roll rotational inertia after completed sheet removal.

Further, the roll fill level indicator arrangement may be arranged on one side of said roll holder in an axial direction of said roll holder, such that said first indicator device is configured to be offset from said absorbent sheet material in an axial direction of said roll holder. This configuration has the advantage of providing a simplified and less complex motion transfer mechanics of the indicator arrangement because the location of the indicator arrangement is not in the path of the sheet material.

Further, the roll engagement means may be arranged to engage the roll mainly on a rear side of said roll as seen from a front of the apparatus. This configuration has the advantage of simplifying replacement of the roll upon depletion, since the roll is often replaced by the service personnel standing in front of the dispenser.

BRIEF DESCRIPTION OF THE DRAWINGS

The present disclosure will now be described in detail with reference to the figures, wherein:

FIG. 4 shows a perspective view the indicator arrangement in a position corresponding to an empty, or nearly empty roll;

FIG. 5 shows a perspective view of the indicator arrangement in a position corresponding to a full, or nearly full roll;

DETAILED DESCRIPTION

Various aspects of embodiments of the apparatus will hereinafter be described in conjunction with the appended drawings to illustrate and not to limit the present disclosure, wherein like designations denote like elements, and variations of the inventive aspects are not restricted to the specifically shown embodiments, but are applicable on other variations of the embodiments.

Figure 1:
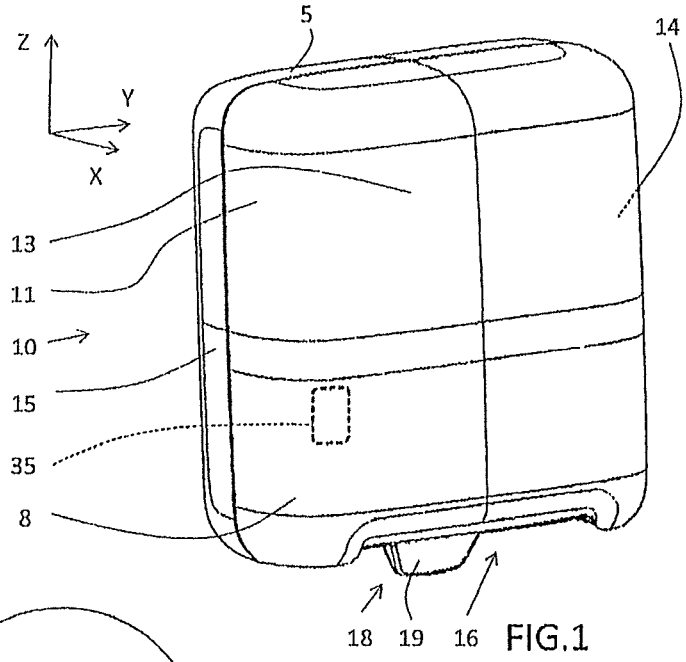
FIG. 1 shows a perspective outer view of the apparatus in an un-opened condition.

FIG. 1 schematically illustrates a first embodiment of the apparatus 10 for dispensing absorbent sheet material. The apparatus 10 comprising a first housing 11 for holding a roll containing a continuous or discontinuous web of absorbent sheet material. The first housing 11, which forms an outer housing, comprises an outer front wall 13 two outer side walls 14, 15, an outer top wall 5, and a dispensing opening 16 for the web adjacent a lower portion of said outer front wall 13. In this example, the entire front of the first housing 11 forms a cover that can be opened by for example pivoting the cover outwards and downwards to allow access to the interior of the apparatus 10 during sheet material re-filling or servicing thereof. A rear wall 2 of the first housing 11 forms a chassis of the apparatus 10 and is provided with attachment means, such as holes, for mounting on a wall. The dispensing apparatus 10 comprises a feeding means for controlling the dispensing of the web from the roll. A manually actuated actuating mechanism 18 is operatively connected to the feeding means, wherein the actuating mechanism 18 is actuated by a user applying a force to a handle 19 to dispense a predetermined length of wiping material through the dispensing opening 16. The handle 19 extends out of a lower portion of the housing 11 adjacent the dispensing opening 16.

The terms "upper", "lower" etc used herein will be defined by means of a Cartesian coordinate system having axis, Y and Z as shown in FIG. 1. The X-axis points from a rear to the front of the apparatus. The Y-axis points from left to the right of the apparatus, and the Z-axis points from a lower to an upper portion of the apparatus. The apparatus 10 is configured to be installed such that the X and Y axis define substantially a horizontal plane, and the Z-axis is parallel with a vertical plane.

Figure 2:
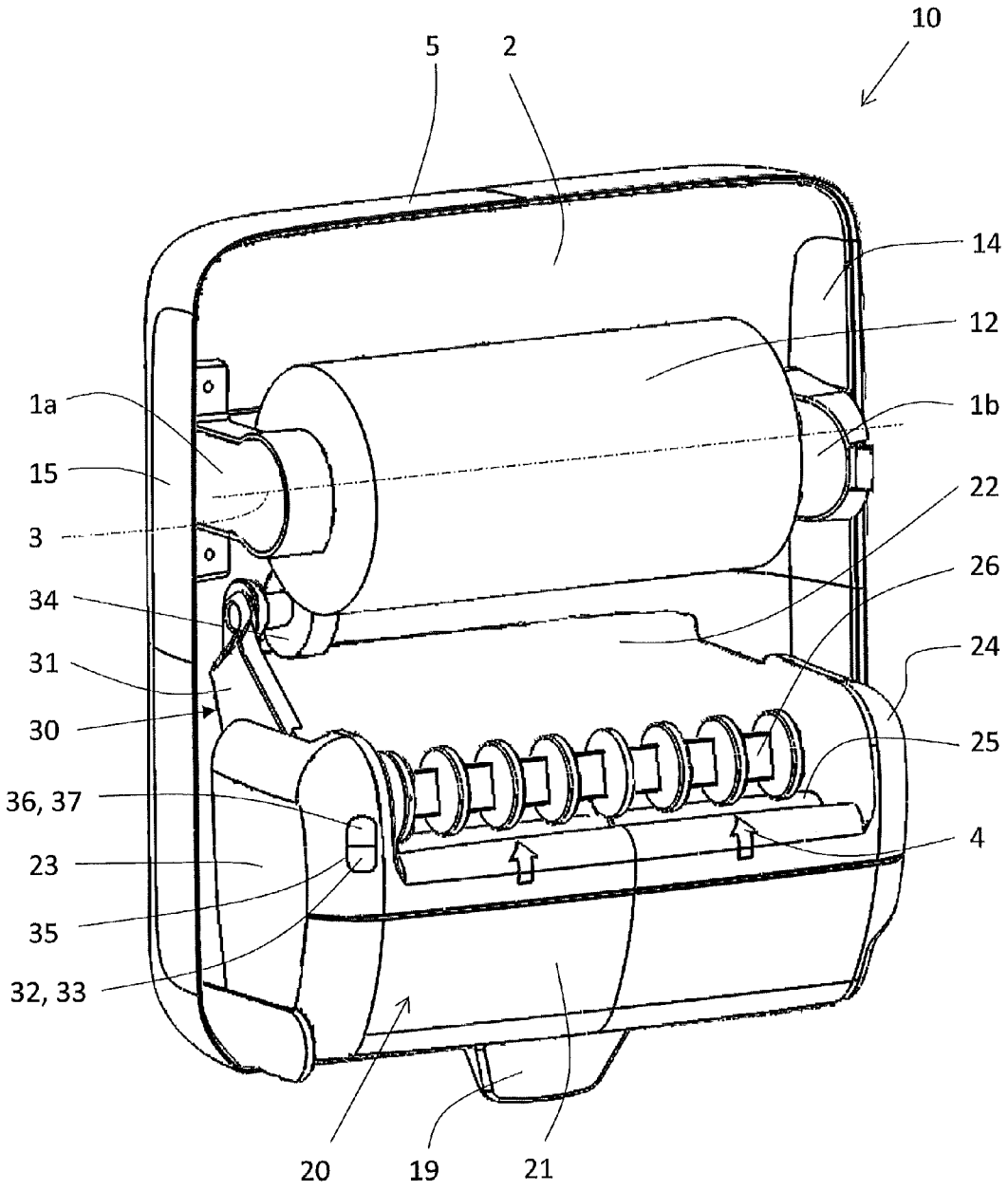
FIG. 2 shows a perspective view the apparatus of FIG. 1 but with a front wall removed.

FIG. 2 schematically illustrates the apparatus 10 of FIG. 1 with a front wall 13 of the first housing 11 removed to expose the inner parts of the dispensing apparatus. The first housing 11 includes a roll 12, a roll holder comprising two arms 1*a*, 1*b*, a roll fill level indicator arrangement 30, and a second housing 20. The arms 1*a*, 1*b*, of the roll holder axially clamps the roll 12 such that the roll 12 remains in place upon sheet material withdrawal, but is configured to allow the roll 12 to rotate freely. The arms 1*a*, 1*b* may for example be separate parts that are connected to the rear wall 2 of the first housing 11, or be integral parts of the first housing 11. The roll holder defines an axial direction 3 that coincides with the axial direction of the roll 12 when mounted within the roll holder arms 1*a*, 1*b*. The roll 12 itself may be any type of cylindrical roll with absorbent sheet material. The sheet material may be a continuous sheet material that is wound on a core 9, or the roll may be of the core-less type. The roll 12 is preferably of a hard wound roll towel type.

In this example the inner, second housing 20 is a cassette which at least partially encloses the feeding means for safety purpose, such that service personnel is prevented from injuries during replacement of the roll 12. The cassette 20 comprises at least a front wall 21, a rear wall 22, left side wall 23, and a right side wall 24. The feeding means comprises at least a drive roller 25, a pressure roller 26 and a cutting device (not shown). In this case, the drive roller 25 is a rotary drum provided with a cutting device in the form of a rotary cutter located in an axial slot in the outer peripheral surface of the rotary drum 25. Cutters of this type are commonly known and will not be described in further detail. The web is arranged to be fed from the roll 12 and into the feeding means as indicated by the arrows 4, for subsequent dispensing out of the dispensing opening 16.

The roll fill level indicator arrangement 30 is partly visible in FIG. 2 and comprises a pivoting arm 31, which includes a wheel 34 that functions as roll engagement means. The wheel 34 is rotatably coupled to an end region of the pivoting arm 31, and is arranged to engage with an outer peripheral surface of the roll 12. The pivoting arm 31 is here pivotally connected to the second housing 20, but the pivoting arm 31 may alternatively be connected to the first housing 11. The angular position of the pivoting arm 31 is arranged to depend on the diameter of the roll 12. A biasing means, such as a spring, continuously urges the pivoting arm 31 towards the roll 12, and thereby functions as a mechanical roll fill level sensor for the indicator arrangement 30.

The indicator arrangement 30 further comprises a moveable first indicator device 32. The position of said first indicator device 32 is continuously responsive to the angular position of said pivoting arm 31, such that said roll fill level indicator arrangement 30 provides a gradual roll fill level indication. A wall, such as the front wall 21 of the cassette 20, is provided with a window 35 that forms a second indicator device. The window 35 is simply a through hole in the wall, and may have any shape, but a rectangular shape is preferred. The first indicator device 32 is arranged inside of said wall 21, and an indicator surface 33 of the first indicator device 32 is visible through said window 35 at least during certain angular positions of the pivoting arm 31, corresponding to certain fill levels of said roll 12. The walls 21, 22, 23, 24 of the cassette 20 are stationary during normal use of the apparatus 11, and a ratio of the indicator surface 33 of the first indictor device 32 that is visible in the window to the total area of the window provides an easily readable and accurate gradual indication of the current roll fill level. According to the first embodiment, an indicator surface 36 of a background indicator device 37 is also visible in the window 35 during certain angular positions of the pivoting arm 31. The background indicator device 37 is stationary with respect to the cassette 20, and is more or less visible to a user or service personal from an outside of the apparatus 10, depending on the position of the first indicator device 32. In the embodiment shown in FIG. 2, the indicator surface 33 of said first indicator device 32 is configured to completely overlap with said window 35 when the pivoting arm 31 is pushed sufficiently towards the rear wall 2 of the first housing 11, corresponding to a relatively full roll due to its relatively large diameter. The indicator surface 33 of the first indicator device 32 may be coloured green, or the like, to symbolise high roll fill level. The indicator surface 36 of the background indicator device 37 may be coloured red, or the like, to symbolise low roll fill level. As a result, as the diameter of the roll gets smaller due to the consumption of the absorbent sheet material, the pivoting arm 31 slowly approaches the centre of the roll 12. Since the pivoting arm 31 and first indicator device 32 are mechanically connected, as will be discussed more in detail later, the first indicator device 32 moves downwards a corresponding amount, such that part of the indicator surface 36 of the background indicator device 37 will become visible. At sufficiently depleted roll, the indicator surface 33 of the first indicator device 32 has moved so far downwards to be completely offset the window 35 in a horizontal plane, such that only the indicator surface 36 of the background indicator device 37 is visible. The gradual roll fill level indication is here additionally realised by the internal relative position of the first indicator device 32 and background indictor device 37.

The background indicator device 37 provides the indicator arrangement 30 with a better readability because the window 35 is always completely filled with an indicator surface 33, 36. However, the background indicator device 37 could alternatively be omitted, and the gradual roll fill level indication would then be realised by the internal relative position of the first indicator device 32 and the window 35 as such.

Figure 3:
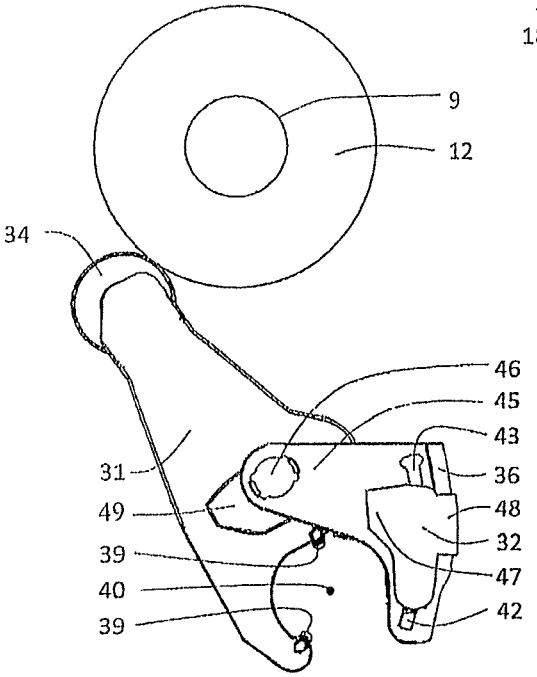
FIG. 3 shows the indicator arrangement from a left side of the apparatus.
Figure 6:
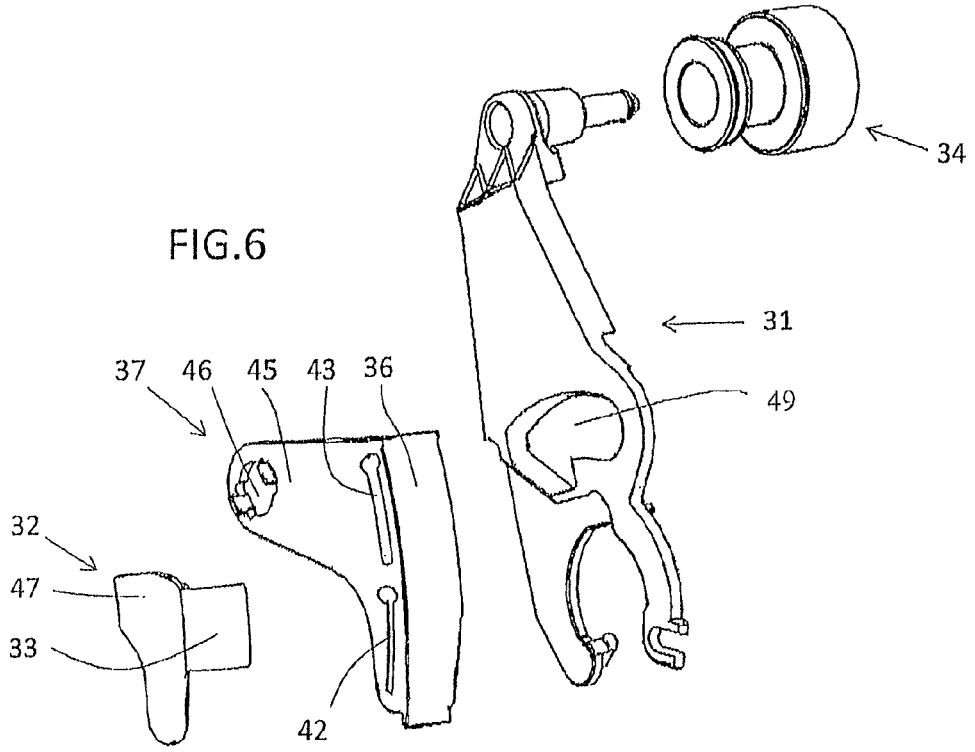
FIG. 6 shows a perspective exploded view of the indicator arrangement.
Figure 7:
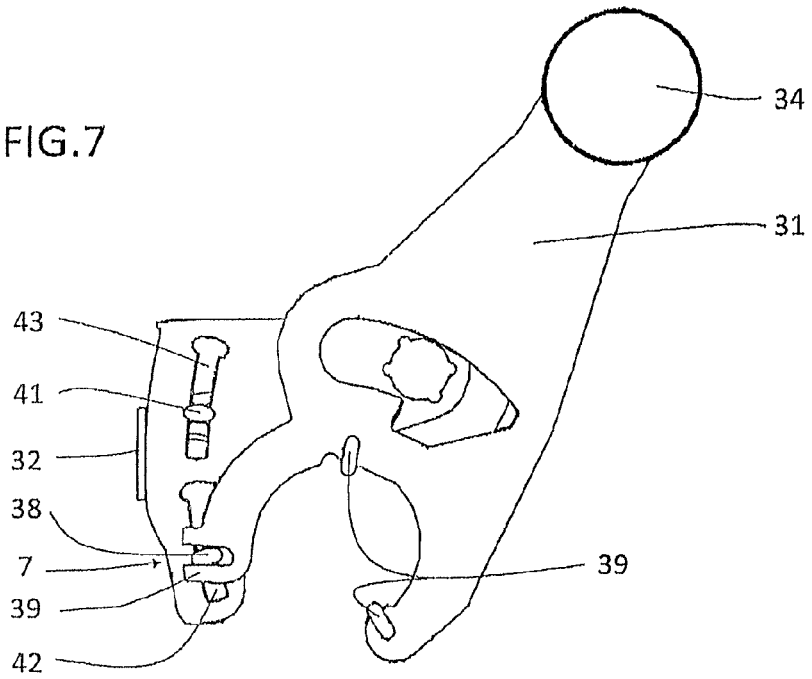
FIG. 7 shows the indicator arrangement from a right side of the apparatus.

Different views of the indicator arrangement 30 of FIG. 2 are illustrated isolated and together with the roll 12 in FIG. 3-7. FIG. 3 shows a view from the left side where the wheel 34 engages the roll 12. The intermediate position of the first indicator device 32 indicates a current roll fill level between a full and empty roll 12. FIGS. 4 and 5 show perspective views of the indicator arrangement 30 in a position corresponding to an empty roll 12, and a position corresponding to a full roll 12, respectively. FIG. 6 illustrates an exploded view and FIG. 7 illustrates a view from the right side of the indicator arrangement 30.

The pivotal arm 31 is pivotally connected to the cassette 20, and thus the first housing 11. The pivotal connection is realised by pins 39 that are slidingly arranged in sliding grooves (not shown) of the second housing 20, such that a pivoting axis 40 is defined. A hole 49 is arranged centrally in the pivoting arm 31 for allowing a stationary mounting of the background indicator device 37 on a shaft (not shown) of the apparatus. The first indicator device 32 is a separate part that is movable connected to said pivoting arm 31 by means of a pivotal connection 7. The pivotal connection 7 is realised by fitting a lower pin 38 of the first indicator device 32 within a yoke 39 of the pivoting arm 31, as seen in FIG. 7. The first indicator device 32 is slidingly arranged in the stationary background indicator device 37 by means of lower and upper pins 38, 41 of the first indicator device 32. Each of the lower and upper pins 38, 41 is configured to slide in an individual sliding track 42, 43 of the background indicator device 37. An enlarged end region of each sliding track 42, 43 allows insertion of the individual pins 38, 41. The sliding motion of the first indicator device 32 is thus partly constrained by this sliding interaction with the background indicator device 37, and partly by the yoke 39 of the pivoting arm 31.

The background indicator device 37 comprises a generally flat rear part 45 with a circular hole 46 for stationary attachment to the cassette 20, or other stationary parts of the apparatus 10, and an indicator surface 36 at a front part, which indicator surface 36 is arranged substantially perpendicular to the rear part 45.

The first indicator device 32 further comprises a generally flat rear part 47, which is arranged to be parallel with the rear part 45 of the background indicator device 37. An indicator surface 33 is provided at a front part of the first indicator device 32, and said indicator surface 33 is arranged to be substantially parallel with the indicator surface 36 of the background indicator device 37. The indicator surfaces 33, 36 of the first indicator device 32 and background indicator device 37 respectively are arranged to be positioned close to each other and slidingly overlapping.

The visible area 50, i.e. the area of the said indicator surfaces 33, 36 that is visible through the window 35 is fictively indicated with a dotted line in FIG. 4 and FIG. 5 for two extreme positions of the pivoting arm 31. In FIG. 4, an empty or nearly empty roll has resulted in a nearly vertical angular position of the pivoting arm 31, and the first indicator device 32 has been moved downwards with a corresponding amount due to the motion control of the first indicator device 32. As a result, the indicator surface 33 of the first indicator device 32 is completely offset the window 35 and thus outside the visible area 50. The indicator surface 33 of the first indicator device 32 is consequently no longer visible by a user or service personnel from the outside of the apparatus 10 with a closed first housing 11. Instead, the indicator surface 36 of the background indicator device 37 completely fills the visible area 50. The indicator surface 36 of the background indicator device 37 may preferably be coloured red, or similar colour, to indicate that the absorbent sheet material is completely or nearly depleted from the roll, and replacement of the roll is required.

In FIG. 5, a full or nearly full roll has resulted in a nearly much more inclined angular position of the pivoting arm 31 towards the rear of the apparatus, and the first indicator device 32 has been moved upwards with a corresponding amount due to the motion control of the first indicator device 32. As a result, the indicator surface 36 of the first indicator device 32 completely overlaps with the visible area 50, and no indicator surface 36 of the background indicator device 37 is visible by a user or service personnel from the outside of the apparatus 10 with a closed first housing 11. The indicator surface 33 of the first indicator device 32 may preferably be coloured green, or similar colour, to indicate that the roll with absorbent sheet material is completely or nearly full, and replacement of the roll 12 is not required.

The ratio of the amount of visible indicator surface 33 of the first indicator device 32 to the amount of visible indicator surface 36 of said background indicator device 37 thus corresponds to current roll fill level. Other colour combinations, or markings, and/or text, than given as example above may of course alternatively be used to visualise and inform the user of the current roll fill level status.

In the disclosed embodiment of FIG. 2-7, the first indicator device 32 is arranged to move along a slightly curved sliding path, but other motion paths are equally possible, such as a straight sliding path. The sliding path will preferably extend in a plane perpendicular to the axial direction 3 of the roll holder to allow to simple and reliable mechanical motion control of the first indicator device 32.

The first indicator device 32 may, according to a non-showed embodiment of the apparatus 10, alternatively be an integral part of the pivoting arm 31. This arrangement would result in an even less complex design, because no pivotal connection between the pivoting arm 31 and first indicator device 32 would be necessary. Moreover, since and the first indicator device 32 would move along a pivotal, arc-shaped path, and supported only by the pivoting arm 31, the sliding tracks 42, 43 and pins 38, 41 would also not be required since no sliding guidance would be required.

In the embodiment shown in FIG. 2-7, the window 35 is arranged in an inner wall 21, 23 of the apparatus, namely a wall 21, 23 of the cassette 20. The window 35 and indicator surfaces 33, 36 of the indicator devices 32, 37 are however visible from the outside of the apparatus 10 by means of a transparent lower portion 8 of the front wall 13 of the first housing 11. Alternatively, the window 35 may be arranged in a front wall 13, a side wall 14, 15 or top wall 5 of the first housing 11, in particular when the apparatus does not exhibit a second, inner housing 20.

The rotatable wheel 34 the forms the roll engagement means is secured to the pivoting arm 31 at an end region thereof. The use of a wheel 34 as engagement means results in low engagement friction. Moreover, the wheel 34 may be configured to apply a rotational braking force to said roll 12 for preventing absorbent sheet material from being uncontrollably unwound from said roll 12. Such an arrangement may be realised by a non-showed drive belt that rotatably connects the wheel 34 with the rotary drum 25, such that the wheel 34 is controlled to rotate only during feeding of absorbent sheet material. Upon ending of sheet material feeding, the wheel 34 stops rotation, and the friction between the outer surface of the roll 12 and wheel 34 quickly stops any further rotation of the roll 12 due to roll inertia from the feeding sequence.

As clearly visible in FIG. 2, the roll fill level indicator arrangement 30 is arranged on one side of said roll holder in an axial direction 3 of said roll holder. This configuration allows the first indicator device 32 to be offset from the absorbent sheet material in said axial direction 3, such that the indicator arrangement 30 may have a simple and reliable design, without complex merging of motion paths of said indicator arrangement 30 and sheet material. Furthermore, handling of the roll 12 during replacement is also simplified by the sideways location of the indicator arrangement 30. The wheel 34 is configured to engage the roll 12 mainly on a rear side and lower side of said roll 12 as seen from a front of the apparatus 10. This arrangement also simplifies handling of the roll 12 during replacement thereof.

Figure 8A:
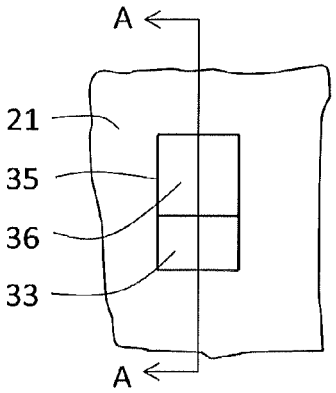
FIG. 8*a* shows a front view of the indicator arrangement.
Figure 8B:
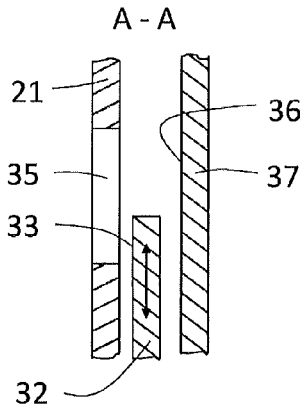
FIG. 8*b* shows a cross-section of the indicator arrangement of FIG. 8*a* along a cut A-A of FIG. 8*a;*
Figure 8C:
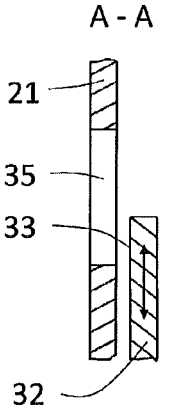
FIG. 8*c* shows a cross-section of the indicator arrangement according to an alternative embodiment.

The indicator arrangement 30 according to the first embodiment includes a window 35, a first indicator device 32, and a background indicator device 37, as described above. This arrangement is also disclosed in FIGS. 8*a* and 8*b*. FIG. 8*a* schematically illustrates the window 35 as seen from a front of the apparatus 10 by the user, with the wall 21 of the cassette 20 surrounding the window 35. FIG. 8*b* schematically shows a cross-section of the arrangement of FIG. 8*a* along the cut A-A. Both the wall 21 and the background indicator device 37 are here stationary, and the first indictor device 32 is moveable along a sliding path in a substantially vertical direction, as illustrated by the arrow. The sliding path may of course be slightly curved, or completely linear. In the fill level position shown, part of the indicator surface 33 of the first indicator device 32 is visible in the lower portion of the window 35, and part of the indicator surface 36 of the background indicator device 37 is visible in the upper portion of the window 35.

Alternatively, the background indicator device 37 may be an integral part of the wall 21. According to yet an alternative embodiment, the background indicator device 37 may be eliminated, and only the relative position of the first indicator device 32 and window 35 is used to determine current roll fill level.

Figure 8D:
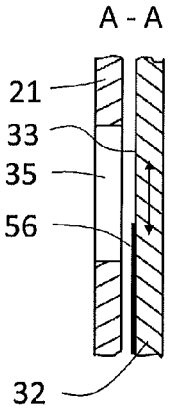
FIG. 8*d* shows a cross-section of the indicator arrangement according to still a further alternative embodiment.

Still a further alternative solution is shown in FIG. 8*d*, where the substantially vertically slidable indicator surface 33 of said first indicator 32 device extends longer than said window 35 in a motion direction of said first indicator device 32. The indicator surface 33 of said first indicator device 32 also has a roll fill level marking 56 that is configured to correspond to a predetermined roll fill level range, such that the marking 56 currently visible in said window indicates the current roll fill level. The roll fill level marking 56 may for example be realised by colouring a lower area of the indicator surface 33 with a first colour, such as green, and colouring an upper area of the indictor surface 33 with a second colour, such as red, and forming the indicator surface 33 and window shape such that a predetermined roll fill level range is provided.

Figure 8E:
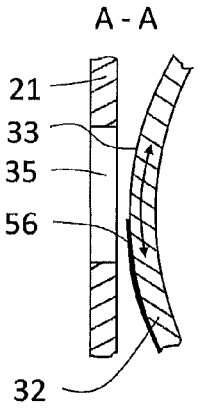
FIG. 8*e* shows a cross-section of the indicator arrangement according to still a further alternative embodiment.

Still a further variant of the embodiment of FIG. 8*d* is shown in FIG. 8*e*, but here the first indicator device 32 is an integral part of the pivoting arm 31, such that the first indicator device 32 exerts a pivoting motion around the same pivoting axis 40 as the pivoting arm 31. The first indicator surface 33 is for this reason arc-shaped to provide a substantially constant relative position to the window 35 over the total fill level range, with only the visible marking 56 on the indicator surface 33 gradually changing in response to the gradual pivoting motion of the pivoting arm 31.

Figure 9A:
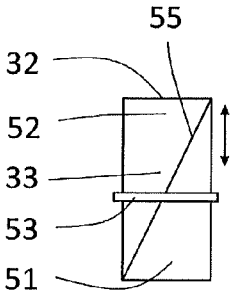
FIG. 9*a* shows a front view of the indicator arrangement according to an still an alternative embodiment.
Figure 9B:
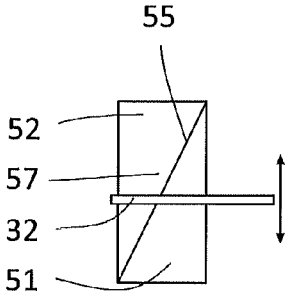
FIG. 9*b* shows a front view of the indicator arrangement according to a still an alternative embodiment.

Still a further alternative embodiment is disclosed in 9*a*, in which the indicator surface 33 of the moveable first indicator device 32 comprises a roll fill level marking that is configured to correspond to a predetermined roll fill level range. For example, a lower area 51 of the indicator surface 33 may be coloured mainly with a first colour, such as green, and an upper area 52 of the indicator surface 33 may be coloured with a second colour, such as red. A ratio of said first colour to said second colour may then gradually change from an upper area to a lower area of the indicator surface 33, for example by means of a diagonal division 55 of the marking on the indicator surface 33. The stationary second indicator device comprises an indicator member that is formed by a fixed bar 53 or similar indicator means for indication of current roll fill level status. A corresponding solution is subsequently shown in FIG. 9*b*, but here the first indicator device 32 is shaped as a bar, and an indicator surface 57 of the second indicator device exhibits said markings of the fill level range. These two last alternative embodiments do not require a window 35 to be present in a wall of the apparatus 10. Instead, the marking may for example be located directly on a wall, or similar member of the apparatus.

The term stationary used herein should be considered relative to the main parts of the apparatus as such, e.g. the first or second housing and their walls.

Reference signs mentioned in the claims should not be seen as limiting the extent of the matter protected by the claims, and their sole function is to make claims easier to understand.

As will be realised, the apparatus for the present disclosure is capable of modification in various obvious respects, all without departing from the scope of the appended claims. Accordingly, the drawings and the description thereto are to be regarded as illustrative in nature, and not restrictive.

The invention claimed is:

1. An apparatus for dispensing absorbent sheet material from a roll, the apparatus comprising:

a roll holder for rotatably supporting said roll; and a roll fill level indicator arrangement, wherein said roll fill level indicator arrangement comprises a pivoting arm and a moveable first indicator device, said pivoting arm comprises roll engagement means for engagement with an outer peripheral surface of said roll, a position of said first indicator device is continuously responsive to an angular position of said pivoting arm, such that said roll fill level indicator arrangement provides a gradual roll fill level indication, and said first indicator device is a separate part that is movably connected to said pivoting arm so that the first indicator device moves relative to said pivoting arm.

2. The apparatus according to claim 1, wherein said roll fill level indicator arrangement further comprises a second indicator device which is stationary with respect to said apparatus, and said gradual roll fill level indication is realized by an internal relative position of said first and second indicator devices.

3. The apparatus according to claim 2, wherein said second indicator device is formed by a window in a stationary wall of said apparatus, wherein an indicator surface of said first indicator device is configured to overlap with said window at least during a predetermined fill level of said roll, such that said indicator surface is visible through said window.

4. The apparatus according to claim 3, wherein said pivoting arm is pivotable between a first position and a second position about a pivoting axis, said indicator surface of said first indicator device is configured to completely overlap with said window when said pivoting arm is in said first position, and said indicator surface of said first indicator device is configured to be completely offset from said window when said pivoting arm is in said second position.

5. The apparatus according to claim 3, wherein said roll fill level indicator arrangement further comprises a background indicator device arranged rear of said first indicator device, and an indicator surface of said background indicator device is configured to be visible in said window when said indicator surface of said first indicator device does not completely overlap with said window.

6. The apparatus according to claim 5, wherein said background indicator device forms a stationary part of said apparatus.

7. The apparatus according to 5, wherein said background indicator device is a separate part of said roll fill level indicator arrangement.

8. The apparatus according to claim 5, wherein a ratio of an amount of visible indicator surface of said first indicator device to an amount of visible indicator surface of said background indicator device is configured to correspond to a current roll fill level.

9. The apparatus according to claim 3, wherein said indicator surface of said first indicator device extends longer than said window in a motion direction of said first indicator device, and said indicator surface of said first indicator device has a roll fill level marking that is configured to correspond to a predetermined roll fill level range, such that a marking currently visible in said window indicates a current roll fill level.

10. The apparatus according to claim 3, wherein said stationary wall is any of a front wall, a side wall, a top wall of a first housing, and an inner wall of a second housing that is visible to a user from an outside of said apparatus.

11. The apparatus according to claim 2, wherein one of said first and second indicator devices comprises a roll fill level marking that is configured to correspond to a predetermined roll fill level range, and the other of said first and second indicator devices comprises an indicator member that is configured to indicate a current roll fill level by interaction with said roll fill level marking.

12. The apparatus according to claim 1, wherein said first indicator device is configured to be slidingly arranged in a recessed portion of said apparatus, and said recessed portion partly constrains sliding motion of said first indicator device.

13. The apparatus according to claim 1, wherein said first indicator device is slidably connected to said pivoting arm, such that pivotal motion of said pivoting arm results in sliding motion of said first indicator device relative to the pivoting arm.

14. The apparatus according to claim 1, wherein said first indicator device is configured to move along a curved or straight sliding path.

15. The apparatus according to claim 1, wherein said first indicator device is configured to move along a linear or a slightly curved path that extends in a plane perpendicular to an axial direction of said roll holder.

16. The apparatus according to claim 1, wherein said first indicator device is an integral part of said pivoting arm.

17. The apparatus according to claim 1, wherein said roll engagement means is formed by a rotatable wheel that is arranged at an end region of said pivoting arm, and said wheel is configured to apply a rotational braking force to said roll for preventing absorbent sheet material from being uncontrollably unwound from said roll.

18. The apparatus according to claim 1, wherein said roll fill level indicator arrangement is arranged on one side of said roll holder in an axial direction of said roll holder, such that said first indicator device is configured to be offset from said absorbent sheet material in the axial direction of said roll holder.

19. The apparatus according to claim 1, wherein said roll engagement means is arranged to engage the roll mainly on a rear side of said roll as seen from a front of the apparatus.

20. The apparatus according to claim 1, wherein the pivoting arm includes a sliding track in a surface of the pivoting arm, and the first indicator device includes a protrusion extending into the sliding track, so that the first indicator device moves relative to the pivoting arm in a direction along the sliding track.

* * * * *